US005536610A

United States Patent [19]

Ojima et al.

[11] Patent Number: 5,536,610

[45] Date of Patent: Jul. 16, 1996

[54] PHOTOSENSITIVE MEMBER HAVING SURFACE PROTECTIVE LAYER WITH SPECIFIED OPTICAL PROPERTIES

[75] Inventors: Seishi Ojima, Takatsuki; Kenji Masaki, Ibaraki; Takeshi Kakutani, Itami; Toshiyuki Kobayashi, Suita; Isao Doi, Toyonaka; Izumi Osawa, Ikeda, all of Japan

[73] Assignee: Minolta Camera Kabushiki Kaisha, Osaka, Japan

[21] Appl. No.: 354,892

[22] Filed: Dec. 9, 1994

Related U.S. Application Data

[63] Continuation of Ser. No. 57,811, May 7, 1993, abandoned.

[30] Foreign Application Priority Data

May 14, 1992 [JP] Japan ..... 4-121783
May 14, 1992 [JP] Japan ..... 4-121785

[51] Int. Cl.[6] ..... G03G 5/147

[52] U.S. Cl. ..... 430/67; 430/66

[58] Field of Search ..... 430/66, 67

[56] References Cited

U.S. PATENT DOCUMENTS

| | | | |
|---|---|---|---|
| 4,810,606 | 3/1989 | Iino et al. | 430/58 |
| 4,863,821 | 9/1989 | Iino et al. | 430/58 |
| 4,882,256 | 11/1989 | Osawa et al. | 430/66 |
| 4,906,544 | 3/1990 | Osawa et al. | 430/58 |
| 5,262,262 | 11/1993 | Yagi et al. | 430/67 X |

*Primary Examiner*—Roland Martin
*Attorney, Agent, or Firm*—McDermott, Will & Emery

[57] ABSTRACT

The present invention provides a photosensitive member composed of a photosensitive layer and a surface protective layer on an electrically substrate in this order, in which the surface protective layer comprises an amorphous carbon layer which has a specified ratio of absorptivity coefficients of infrared absorption peaks in infrared absorption spectrum.

27 Claims, 5 Drawing Sheets

PHOTOSENSITIVE MEMBER HAVING SURFACE PROTECTIVE LAYER WITH SPECIFIED OPTICAL PROPERTIES

This is a continuation application of U.S. patent application Ser. No. 08/057,811 filed May 7, 1993, now abandoned.

BACKGROUND OF THE INVENTION

The present invention relates to a photosensitive member for copying machine, in particular, a photosensitive member excellent in resolution even after used for a long time.

Recently an amorphous carbon layer has been used as a surface protective layer of a photosensitive member for electrophotography in order to improve heat resistance, humidity resistance, durability with respect to copy. The surface protective layer is formed from vapor of butadiene or other compounds on a photosensitive member by means of P-CVD method (plasma vapor deposition).

The surface protective layer for a photosensitive member should have light transmittance excellent enough not to lower resolution properties as well as abrasion resistance, humidity resistance and durability. It is also required to resist electrical charging when used repeatedly.

However deterioration of sensitivity caused by lowering of light transmittance and deterioration of resolution properties caused by electrical charging are brought about in a photosensitive member with a surface protective layer formed of an amorphous carbon layer prepared by a conventional P-CVD method.

SUMMARY OF THE INVENTION

The object of the present invention is to provide a photosensitive member with a light transmittable amorphous carbon layer as a surface protective layer which does not cause deterioration of resolution properties and deterioration caused by electrical charging.

The present invention relates to a photosensitive member composed of a photosensitive layer and a surface protective layer on an electrically conductive substrate in this order, in which the surface protective layer comprises an amorphous carbon layer which has a specified ratio of absorptivity coefficients of infrared absorption peaks in infrared absorption spectrum.

DETAILED DESCRIPTION OF THE INVENTION

Figure 1:
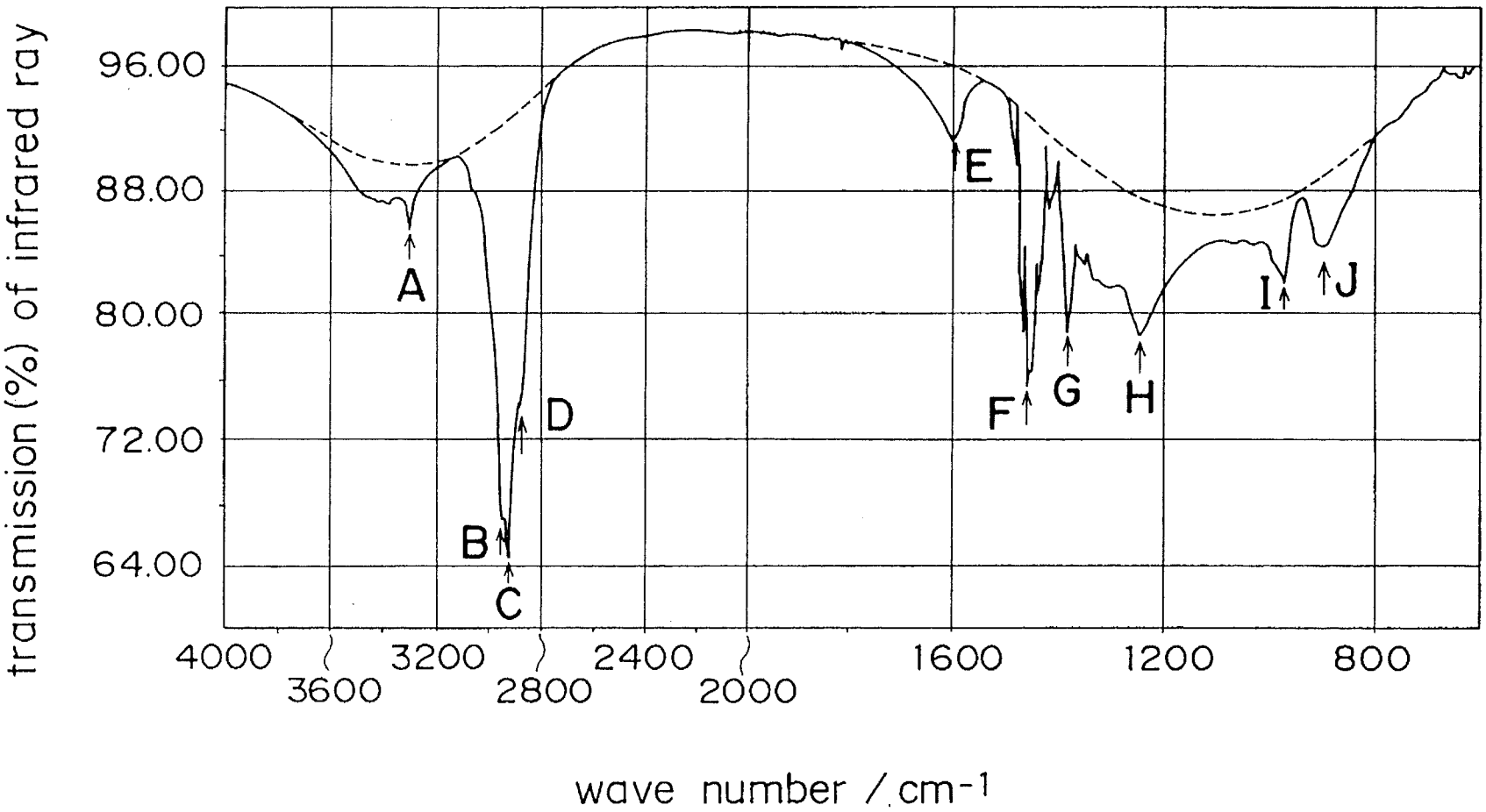
FIG. 1 is an example of infrared absorption spectra of amorphous carbon layer as surface protective layer of the present invention.

The present invention provides a photosensitive member excellent in resolution properties and without deterioration caused by electrical charging, even after use for a long time.

The present invention has accomplished the above object by forming an amorphous carbon layer as a surface protective layer having a specified ratio with respect to infrared absorption peaks.

The present invention relates to a photosensitive member composed of a photosensitive layer and a surface protective layer on an electrically conductive substrate in this order, in which the surface protective layer comprises an amorphous carbon layer which is specified by a following ratio of infrared absorption peaks in infrared absorption spectrum;

- a ratio ($\alpha_B/\alpha_l$) of absorptivity coefficient ($\alpha_B$) of absorption peak (B) in the range of 2960±10 $cm^{-1}$ to absorptivity coefficient ($\alpha_l$) of absorption peak (l) in the range of 970±10 $cm^{-1}$ is 5.2 or more, preferably 6.6 or more,
- a ratio ($\alpha_C/\alpha_l$) of absorptivity coefficient ($\alpha_C$) of absorption peak (C) in the range of 2930±10 $cm^{-1}$ to absorptivity coefficient ($\alpha_l$) of absorption peak (l) in the range of 970±10 $cm^{-1}$ is 5.8 or more, preferably 7.3 or more,
- a ratio ($\alpha_D/\alpha_l$) of absorptivity coefficient ($\alpha_D$) of absorption peak (D) in the range of 2870±10 $cm^{-1}$ to absorptivity coefficient ($\alpha_l$) of absorption peak (l) in the range of 970±10 $cm^{-1}$ is 3.7 or more, preferably 4.3 or more,
- a ratio ($\alpha_E/\alpha_l$) of absorptivity coefficient ($\alpha_E$) of absorption peak (E) in the range of 1600±40 $cm^{-1}$ to absorptivity coefficient ($\alpha_l$) of absorption peak (1) in the range of 970±10 $cm^{-1}$ is 0.8 or more, preferably 2.2 or more,
- a ratio ($\alpha_F/\alpha_l$) of absorptivity coefficient ($\alpha_F$) of absorption peak (F) in the range of 1460±20 $cm^{-1}$ to absorptivity coefficient ($\alpha_l$) of absorption peak (l) in the range of 970±10 $cm^{-1}$ is 3.3 or more, preferably 6.0 or more,
- a ratio ($\alpha_H/\alpha_l$) of absorptivity coefficient ($\alpha_H$) of absorption peak (E) in the range of 1240±10 $cm^{-1}$ to absorptivity coefficient ($\alpha_l$) of absorption peak (l) in the range of 970±10 $cm^{-1}$ is 1.6 or more, preferably 5.1 or more,
- a ratio ($\alpha_E/\alpha_A$) of absorptivity coefficient ($\alpha_E$) of absorption peak (E) in the range of 1600±40 $cm^{-1}$ to absorptivity coefficient ($\alpha_A$) of absorption peak (A) in the range of 3310+10 $cm^{-1}$ is 1.0 or more, preferably 3.9 or more,
- a ratio ($\alpha_G/\alpha_A$) of absorptivity coefficient ($\alpha_G$) of absorption peak (G) in the range of 1380±10 $cm^{-1}$ to absorptivity coefficient ($\alpha_A$) of absorption peak (A) in the range of 3310±10 $cm^{-1}$ is 3.8 or more, preferably 4.8 or more, or
- a ratio ($\alpha_E/\alpha_J$) of absorptivity coefficient ($\alpha_E$) of absorption peak (E) in the range of 1600±40 $cm^{-1}$ to absorptivity coefficient ($\alpha_J$) of absorption peak (J) in the range of 890±10 $cm^{-1}$ is 1.1 or more, preferably 1.8 or more.

When a surface protective layer is formed of an amorphous carbon layer having structural characteristics as shown by the above infrared absorption spectrum, a photosensitive member is excellent in resolution properties even after use for a long time.

An amorphous carbon layer formed as a surface protective layer shows typical 10 infrared absorption peaks below in the present invention. In embodiment, it is easy to recognize the infrared absorption peaks by referring to FIG. 1 which is infrared absorption spectrum of the amorphous carbon layer prepared in Example 1:

(1) The arrow A points to absorption peak observed in the range of 3310±10 $cm^{-1}$ (absorptivity coefficient of this peak is referred to as $\alpha_A$).

This peak may be attributed to a –OH group bonded to polymer chain and a –OH group of water adsorbed on the surface.

(2) The arrow B points to absorption peak observed in the range of 2960±10 $cm^{-1}$ (absorptivity coefficient of this peak is referred to as $\alpha_B$).

This peak is attributed principally to stretching vibration of $-CH_3$. This peak may be observed as a shoulder because the adjacent absorption at 2930 $cm^{-1}$ is strong.

(3) The arrow C points to absorption peak observed in the range of 2930±10 $cm^{-1}$ (absorptivity coefficient of this peak is referred to as $\alpha_C$).

This peak is attributed principally to stretching vibration of $-CH_2-$.

(4) The arrow D points to absorption peak observed in the range of 2870±10 $cm^{-1}$ (absorptivity coefficient of this peak is referred to as $\alpha_D$).

This peak is attributed principally to stretching vibration of $-CH_3$. This peak may be observed as a shoulder because the adjacent absorption at 2930 $cm^{-1}$ is strong.

(5) The arrow E points to absorption peak observed in the range of 1600±40 $cm^{-1}$ (absorptivity coefficient of this peak is referred to as $\alpha_E$).

This peak is attributed principally to vibration of C=C. The absorptions caused by the following structures;

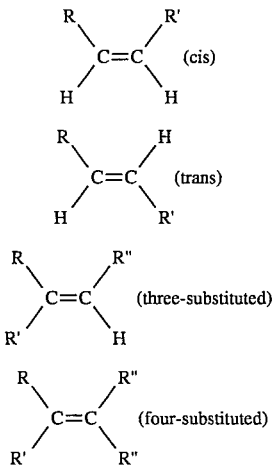

overlap each other to form the absorption peak E.

(6) The arrow F points to absorption peak observed in the range of 1460±20 $cm^{-1}$ (absorptivity coefficient of this peak is referred to as $\alpha_F$).

This peak is attributed principally to deforming vibration of $-CH_3$ and stretching vibration of $-CH_2-$. These two absorptions overlap each other to form the absorption peak F.

(7) The arrow G points to absorption peak observed in the range of 1380±10 $cm^{-1}$ (absorptivity coefficient of this peak is referred to as $\alpha_G$).

This peak is attributed principally to deforming vibration of $-CH_3$.

(8) The arrow H points to absorption peak observed in the range of 1240±10 $cm^{-1}$ (absorptivity coefficient of this peak is referred to as $\alpha_H$).

This peak is attributed principally to $-C(CH_3)_3$, and may be formed with other absorption overlapping because of wide width of this peak.

(9) The arrow l points to absorption peak observed in the range of 970±10 $cm^{-1}$ (absorptivity coefficient of this peak is referred to as $\alpha_l$).

The absorption attributed to a terminal vinyl group $R-CH=CH_2$ and the absorption attributed to RCH=CHR'(trans) overlap each other to form the absorption peak l.

(10) The arrow J points to absorption peak observed in the range of 890±10 $cm^{-1}$ (absorptivity coefficient of this peak is referred to as $\alpha_J$).

The absorption attributed to a terminal methylene group $(R)_2-C=CH_2$ and the absorption attributed to a terminal vinyl group $R-CH=CH_2$ overlap each other to form the absorption peak J.

The effects of the present invention can be obtained when a surface protective layer has the above characteristic infrared absorption peaks at a specified ratio of the absorptivity coefficients ($\alpha_B$, $\alpha_C$, $\alpha_D$, $\alpha_E$, $\alpha_F$ or $\alpha_H$) to the absorptivity coefficient ($\alpha_l$).

In infrared absorption spectrum, a ratio ($\alpha_B/\alpha_l$) of absorptivity coefficient ($\alpha_B$) of absorption peak (B) in the range of 2960±10 $cm^{-1}$ to absorptivity coefficient ($\alpha_l$) of absorption peak (l) in the range of 970±10 $cm^{-1}$ is 5.2 or more, preferably 6.6 or more, a ratio ($\alpha_C/\alpha_l$) of absorptivity coefficient ($\alpha_C$) of absorption peak (C) in the range of 2930±10 $cm^{-1}$ to absorptivity coefficient ($\alpha_l$) of absorption peak (l) in the range of 970±10 $cm^{-1}$ is 5.8 or more, preferably 7.3 or more, a ratio ($\alpha_D/\alpha_l$) of absorptivity coefficient ($\alpha_D$) of absorption peak (D) in the range of 2870±10 $cm^{-1}$ to absorptivity coefficient ($\alpha_l$) of absorption peak (l) in the range of 970±10 $cm^{-1}$ is 3.7 or more, preferably 4.3 or more, a ratio ($\alpha_E/\alpha_l$) of absorptivity coefficient ($\alpha_E$) of absorption peak (E) in the range of 1600±40 $cm^{-1}$ to absorptivity coefficient ($\alpha_l$) of absorption peak (l) in the range of 970±10 $cm^{-1}$ is 0.8 or more, preferably 2.2 or more, a ratio ($\alpha_F/\alpha_l$) of absorptivity coefficient ($\alpha_F$) of absorption peak (F)in the range of 1460±20 $cm^{-1}$ to absorptivity coefficient ($\alpha_l$) of absorption peak (l) in the range of 970±10 $cm^{-1}$ is 3.3 or more, preferably 6.0 or more, or a ratio ($\alpha_H/\alpha_l$) of absorptivity coefficient ($\alpha_H$) of absorption peak (H)in the range of 1240±10 $cm^{-1}$ to absorptivity coefficient ($\alpha_l$) of absorption peak (l) in the range of 970±10 $cm^{-1}$ is 1.6 or more, preferably 5.1 or more, It is required for at least one of the ratios of $\alpha_B/\alpha_l$, $\alpha_C/\alpha_l$, $\alpha_D/\alpha_l$, $\alpha_E/\alpha_l$, $\alpha_F/\alpha_l$ and $\alpha_H/\alpha_l$ are within the range above mentioned so far as an amorphous carbon layer has the above characteristic ten absorptions. When none of the ratios of $\alpha_B/\alpha_l$, $\alpha_C/\alpha_l$, $\alpha_D/\alpha_l$, $\alpha_E/\alpha_l$, $\alpha_F/\alpha_l$ and $\alpha_H/\alpha_l$ are within the above range, the objects of the present invention can not be achieved effectively.

The effects of the present invention can be also obtained when a surface protective layer has relationship between absorptivity coefficients $\alpha_A$, $\alpha_E$, $\alpha_G$ and $\alpha_J$. An amorphous carbon layer of the present invention:

In infrared absorption spectrum, a ratio ($\alpha_E/\alpha_A$) of absorptivity coefficient ($\alpha_E$) of absorption peak (E)in the range of 1600±40 $cm^{-1}$ to absorptivity coefficient ($\alpha_A$) of absorption peak (A) in the range of 3310±10 $cm^{-1}$ is 1.0 or more, preferably 3.9 or more, a ratio ($\alpha_G/\alpha_A$) of absorptivity coefficient ($\alpha_G$) of absorption peak (G)in the range of 1380±10 $cm^{-1}$ to absorptivity coefficient ($\alpha_A$) Of absorption peak (A) in the range of 3310±10 $cm^{-1}$ is 3.8 or more, preferably 4.8 or more, or a ratio ($\alpha_E/\alpha_J$) of absorptivity coefficient ($\alpha_E$) of absorption peak (E) in the range of 1600±40 $cm^{-1}$ to absorptivity coefficient ($\alpha_J$) of absorption peak (J) in the range of 890±10 $cm^{-1}$ is 1.1 or more, preferably 1.8 or more.

It is required for at least one of the ratios of $\alpha_E/\alpha_A$, $\alpha_G/\alpha_A$, and $\alpha_E/\alpha_J$ to be within the range above mentioned so far as an amorphous carbon layer has the above characteristic ten absorptions. When none of the ratios of $\alpha_E/\alpha_A$, $\alpha_G/\alpha_A$, and $\alpha_E/\alpha_J$ are within the above range, the objects of the present invention can not be achieved effectively.

In the present invention, absorptivity coefficient means a value measured, for example, with the dotted-line curve as a base line in infrared absorption spectrum of FIG. 1.

A surface protective layer as a surface protective layer having such structural characteristics as shown by the above infrared absorption spectrum can be prepared by a conventional plasma deposition method. However, the plasma deposition method depends much on apparatus forms, preparing conditions and the like. Therefore it is necessary to select kind of raw material gas, kind of carrier gas, gas-mixing method, gas-inlet method into bell-jar and to adjust exhaust forms, pressure, electric power, frequency, wave form of electric power, bias of direct current, temperature of substrate, sequence control of decrease and increase of substrate temperature, electric power-applying method, layer-forming time and the like. The surface protective layer is prepared by means of a P-CVD method, a light-CVD method, a thermal-CVD method, an ion-plating method, a spattering method or the like.

A photosensitive layer is formed under the surface protective layer.

The photosensitive layer is composed of well known materials selected adequately from charge generating materials, charge transporting materials, binder resins and the like. The present invention may be applied to any type of photosensitive members such as a photosensitive member of laminated type in which a charge transporting layer is formed on a charge generating layer, a photosensitive member of reverse-laminated type in which a charge generating layer is formed on a charge transporting layer and a photosensitive member of single-layer type which has both charge generating function and charge transporting function.

Moreover the photosensitive member may be formed not only of organic materials but also of inorganic materials such as zinc oxide, cadmium sulfide, selenium alloy and amorphous silicon alloy.

A photosensitive layer used in the present invention may have an undercoat layer in order to improve chargeability, image-quality and adhesivity. The undercoat layer may be formed of resins such as ultraviolet curing resins, cold-setting resins and thermosetting resins, mixed resins containing electric resistance-adjusting agent therein, thin layers of metal oxides or metal sulfides prepared in vacuum by a vapor deposition method or an ion-plating method, and amorphous carbon layers and amorphous silicone carbides prepared by a plasma polymerization method.

Any material may be applied to a substrate so far as the surface of the substrate is electrically conductive. A shape of the substrate may be cylindrical, flat or belt-like. The surface of the substrate may be subjected to a roughening treatment, an oxidizing treatment or a coloring treatment.

A surface protective layer of the present invention can transmit effectively visible light and rays having wavelength longer than that of visible light. A photosensitive member of the present invention can be applied in accordance with sensitive area of a photosensitive layer to image-forming systems with visible light as light source, such as shutter array for liquid crystal and schuter array for PLZT, and image-forming systems of analog type assembled with visible-light source and lens-mirror optical system which are used in usual in a conventional copying machine. Further a photosensitive member is not limited to the one having sensitivity in visible area but may be applied to image-forming systems using long wave rays such as semiconductor laser (780 nm) and LED array (680 nm).

Specific examples are shown below.

EXAMPLE

Preparation of Photosensitive Member

Preparation of charge generating layer

Azo compound represented by the formula below:

Chemical Formula I

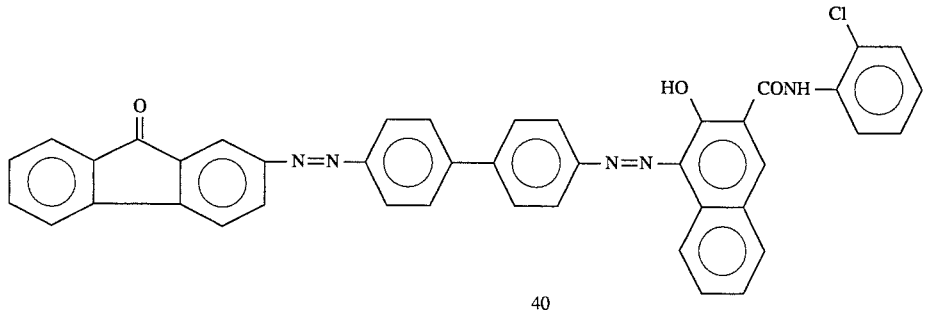

of 0.45 parts by weight, polyester resin (Vylon 200;made by Toyo Boseki K.K.) of 0.45 parts by weight and cyclohexanone of 50 parts by weight were placed in Sand grinder to be mixed for 24 hours. Thus a photosensitive coating solution was obtained. The viscosity of the coating solution was 20 cp at 20° C.

The coating solution was applied to a cylindrical substrate made of aluminum (outer diameter of 100 mm, length of 340 mm, thickness of 2 mm) by a dipping method so that a charge generating layer might have thickness of 0.3 μm after dried. The aluminum substrate was an alloy containing 0.7 percents by weight of magnesium and 0.4 percents by weight of silicon. The drying was carried out in circulating atmosphere at 20° C. for 30 minutes.

Preparation of Charge Transporting Layer

Then a solution containing a styryl compound represented by the following formula;

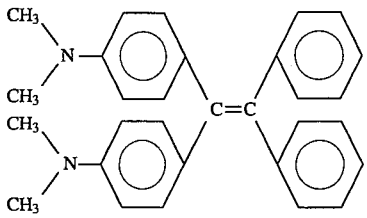

Chemical formula II of 10 parts by weight, polycarbonate resin (Panlite K-1300; made by Teijin Kasei K.K.) in 1,4-dioxane of 40 parts by weight was applied onto the photosensitive layer by a dipping method so that a charge transporting layer might have thickness of 32 μm after dried. The viscosity of the coating solution was 240 cp at 20° C. The drying was carried out in circulating atmosphere at 100° C. for 30 minutes.

Thus a photosensitive member having a charge generating layer and a charge transporting layer on a substrate in this order was obtained.

Formation of Amorphous Carbon Layer as Surface Protective Layer

Figure 2:
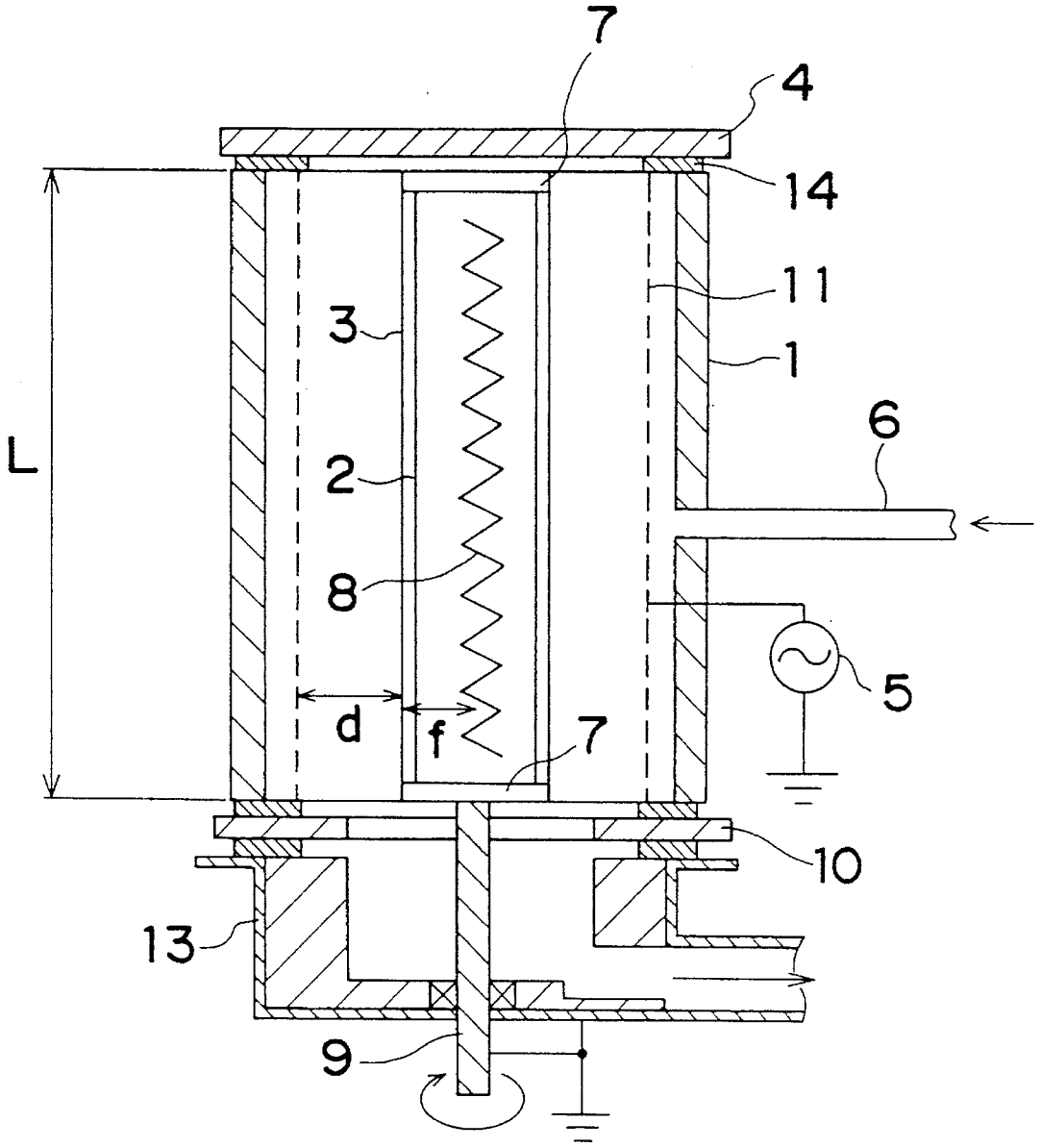
FIG. 2 is a schematic illustration of P-CVD apparatus for a cylindrical substrate.

An amorphous carbon layer was prepared as a surface protective layer by a plasma deposition method on the cylindrical photosensitive member prepared above by use of a P-CVD apparatus shown in FIG. 2.

The photosensitive drum (3) was set with a chucking material (7) on a drum holder (2) connected to a revolving shaft (Teflon/stainless) (9) covered with an insulating material. The inside of a bell jar (1) made by pyrex glass was vacuumized to a level of about $10^{-4}$ torr by use of a rotary pump and a mechanical booster pump. The photosensitive member was heated to 50° C. by a heater (8) installed inside the drum holder (2). This heating operation is to prevent the surface of the photosensitive member from being overcooled by the following provision of gases and to keep temperature of the photosensitive member constant in order to elevate experimental precision. The temperature of the heater is not limited so far as the photosensitive member is not deteriorated. The temperature is adjusted in general in the range between 20° C. and 100° C. although in this Example the temperature was set at 50° C. The temperature of the heater was kept constant by means of a thermocouple (not shown) installed in the holder (2) and a controller (not shown) which controls current amount provided for the heater according to signals given by the thermocouple.

Raw material gases were provided through a gas-supplying line (6). The inside of the bell jar was adjusted to a specified level of pressure while a vacuumizing rate was controlled by a exhaust valve (not shown). The pressure inside the bell jar was monitored Pirani vacuum gauge (not shown).

After gas flow rate and the pressure inside the bell jar were stabilized, alternating electric current was applied to a stainless electrode (11) having pores for gas provision, so that plasma having electric power R (W) was generated in the bell jar. The discharging time was selected adequately to form an amorphous carbon layer as a surface protective layer having thickness of 0.1 μm. In the P-CVD apparatus shown in FIG. 2, the interface between the bell jar (1) and an insulating ceiling plate (4) was sealed with rubber seal (14), and the interface between the bell jar and exhaust duct (13) with an insulating ceiling plate (10) made by Teflon.

In Examples 1–7, and Comparative Examples 1 and 2, amorphous carbon layers were formed as surface protective layers by the apparatus and method above mentioned under conditions such as raw material gases (kind and flow rate), carrier gases (kind and flow late), pressure at reaction, discharging electric power, discharging frequency and layer-forming time as shown in Table 1.

TABLE 1

| | layer-producing apparatus | layer-forming conditions: raw material gas kind | raw material gas flow [sccm] | carrier gas kind | carrier gas flow [sccm] |
|---|---|---|---|---|---|
| Comparative Example 1 | cylindrical | butadiene | 35 | hydrogen | 200 |
| Example 1 | cylindrical | butadiene | 15 | hydrogen | 300 |
| Example 2 | cylindrical | butadiene | 25 | hydrogen | 200 |
| Example 3 | cylindrical | butadiene | 15 | hydrogen | 135 |
| Comparative Example 2 | cylindrical | butadiene | 15 | hydrogen + helium | 115 40 |
| Example 4 | cylindrical | butadiene | 20 | hydrogen + helium | 100 100 |
| Example 5 | cylindrical | butadiene | 20 | hydrogen + helium | 150 50 |
| Example 6 | cylindrical | butadiene | 20 | hydrogen + helium | 150 50 |
| Example 7 | cylindrical | propylene | 30 | hydrogen | 135 |

| | layer-forming conditions: pressure at reaction [Toor] | electric power of discharge [w] | frequency of discharge [Hz] | layer-forming time [sec.] |
|---|---|---|---|---|
| Comparative Example 1 | 1.0 | 300 | 80K | 190 |
| Example 1 | 1.0 | 150 | 80K | 230 |
| Example 2 | 1.5 | 350 | 80K | 140 |
| Example 3 | 1.0 | 350 | 80K | 180 |
| Comparative Example 2 | 1.5 | 250 | 80K | 210 |
| Example 4 | 1.5 | 300 | 80K | 200 |
| Example 5 | 1.5 | 300 | 80K | 220 |
| Example 6 | 1.5 | 350 | 80K | 180 |
| Example 7 | 1.0 | 350 | 100K | 300 |

Layer properties of the obtained surface protective layers (layer thickness and absorptivity coefficient of visible rays), ratio of absorptivity coefficient of infrared rays and performance of photosensitive members (resolution power) were shown in Table 2.

Figure 3:
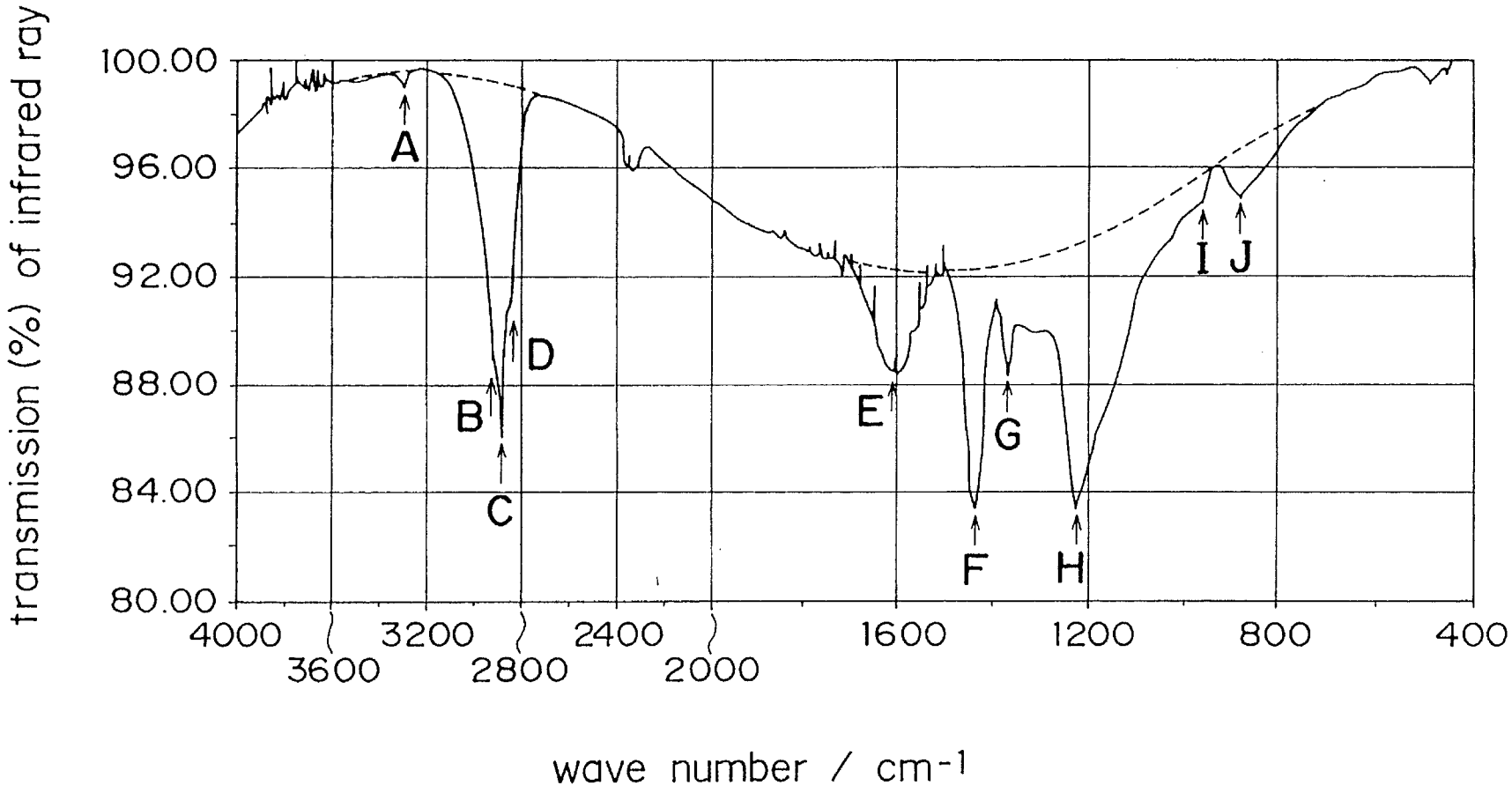
FIG. 3 is an example of infrared absorption spectra of amorphous carbon layer as surface protective layer of the present invention.
Figure 4:
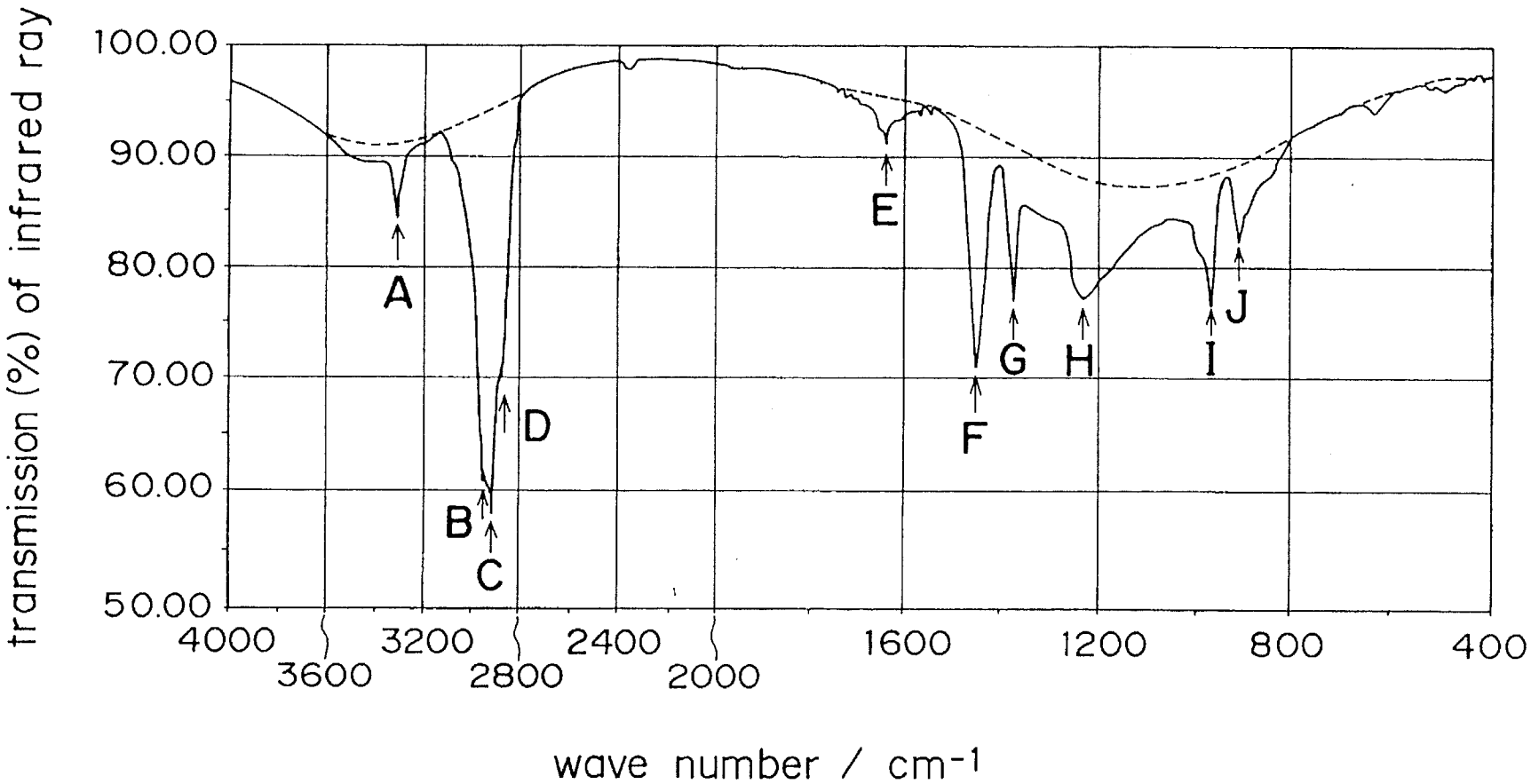
FIG. 4 is an example of infrared absorption spectra of amorphous carbon layer as surface protective layer of conventional case.

Infrared absorption spectra of surface protective layers obtained in Example 1, Example 3 and Comparative Example 1 were shown in FIG. 1, FIG. 3 and FIG. 4. In the figures, the arrows designated as the capital letters A, B, C, D, E, F, G, H, I and J correspond to absorption peaks respectively as described above.

The infrared absorption spectrum was measured with respect to a layer of 0.8–1.4 μm formed on a Si wafer under the same conditions as in the preparation of the surface protective layer. The measurement of the infrared absorption spectrum was carried out by an infrared spectrometer Model JIR 5500 (made by Nippon Densi K.K.) under such conditions as resolution power of 4 $cm^{-1}$ and scanning number of 10 times.

Further a comment in Table 2 was made as below

TABLE 2

| | | Comparative Example 1 | Example 1 | Example 2 | Example 3 | Comparative Example 2 | Example 4 | Example 5 | Example 6 | Example 7 |
|---|---|---|---|---|---|---|---|---|---|---|
| layer properties | layer thickness [μm] | 0.1 | 0.1 | 0.1 | 0.1 | 0.1 | 0.1 | 0.1 | 0.1 | 0.2 |
| | absorptivity coefficient of visible lights [$cm^{-1}$] | 6400 | 3800 | 3400 | 6500 | 5800 | 3800 | 4100 | 4030 | 5400 |
| ratio of absorptivity coefficient of infrared rays | $\alpha_B/\alpha_I$ | 3.0 | 5.2 | 6.6 | 8.7 | 3.7 | 5.7 | 6.7 | 8.8 | 7.4 |
| | $\alpha_C/\alpha_I$ | 3.3 | 5.8 | 7.3 | 10.3 | 4.1 | 6.5 | 7.6 | 11.0 | 8.8 |
| | $\alpha_D/\alpha_I$ | 2.1 | 3.7 | 4.3 | 7.0 | 2.6 | 4.0 | 4.4 | 7.2 | 5.9 |
| | $\alpha_E/\alpha_I$ | 0.3 | 0.8 | 2.2 | 3.4 | 0.4 | 1.3 | 2.3 | 3.4 | 2.8 |
| | $\alpha_F/\alpha_I$ | 1.9 | 3.3 | 6.0 | 8.2 | 2.3 | 4.1 | 6.4 | 8.7 | 7.5 |
| | $\alpha_H/\alpha_I$ | 0.9 | 1.6 | 5.1 | 9.0 | 1.2 | 2.8 | 5.7 | 10.4 | 7.3 |
| | $\alpha_E/\alpha_A$ | 0.5 | 1.0 | 3.9 | 5.4 | 0.6 | 1.7 | 4.0 | 5.5 | 4.3 |
| | $\alpha_G/\alpha_A$ | 2.1 | 3.8 | 4.8 | 5.9 | 2.6 | 4.2 | 4.8 | 6.0 | 5.2 |
| | $\alpha_E/\alpha_J$ | 0.6 | 1.1 | 1.8 | 2.5 | 0.7 | 1.4 | 1.9 | 2.7 | 2.2 |
| performance of photosensitive member | resolution properties after 50K times of copy [lines/nm] | 3.5 | 6.5 | 7.5 | 7.5 | 4.0 | 7.0 | 7.5 | 7.5 | 7.5 |
| | comments | x | o | o | o | x | o | o | o | o |

In the Table 2, the resolution power was measured after a photosensitive member was subjected to 5000 times of copy in a copying machine (EP8600; made by Minolta Camera K.K.). The model EP8600 was remodeled for negative charging.

Figure 5:
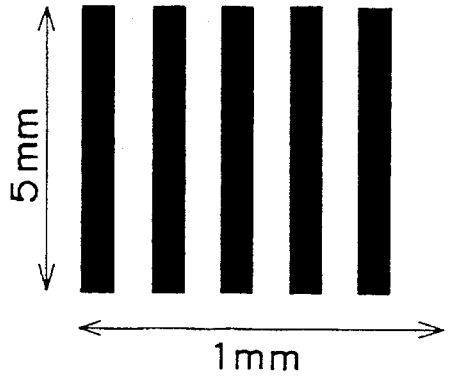
FIG. 5 is an enlarged view of a chart for evaluation of resolution properties (5 lines/mm).

With respect to a chart for evaluating resolution power, the one with pairs of black-white lines arranged as shown in FIG. 5 was used. FIG. 5 has five black lines per mm. Various kinds of charts having six lines per mm, seven lines per mm and the like were used.

Figure 6:
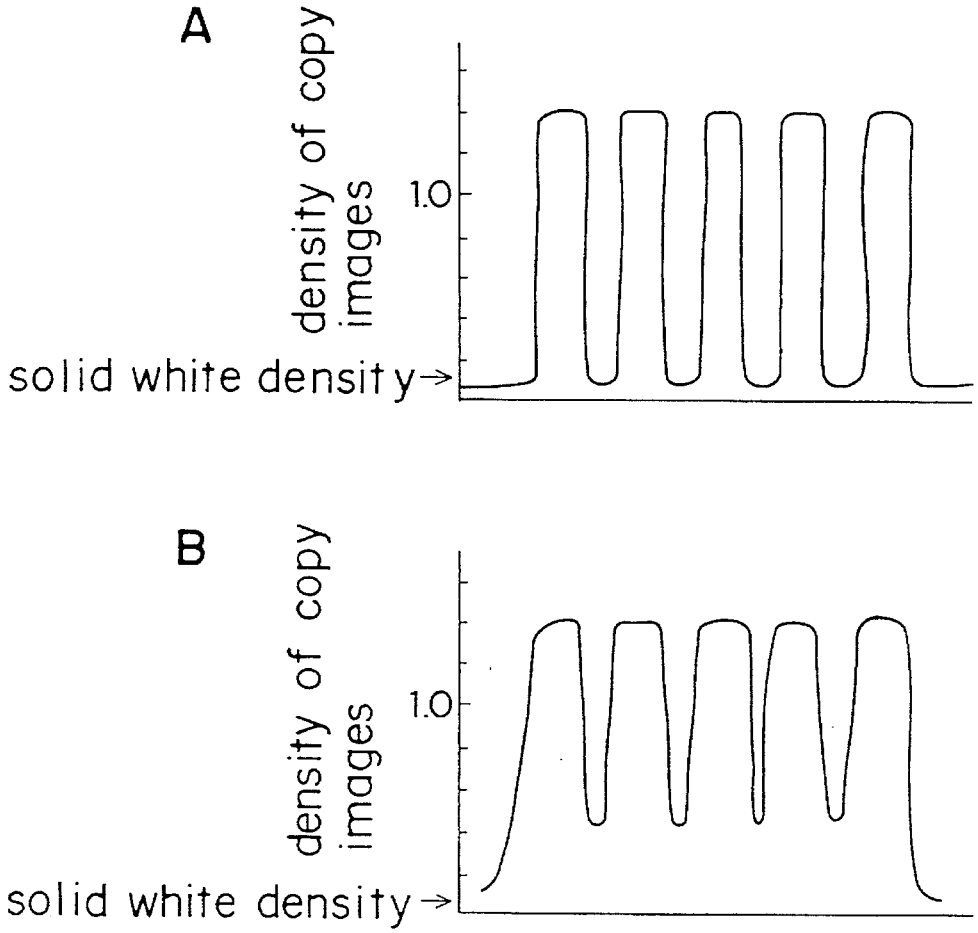
FIGS. 6(A) and (B) show charts respectively for explaining evaluation of copy images by use of a chart for evaluation of resolution properties.

Copy images formed by use of the above charts were analyzed by a densitometer (Sakura Densitometer Model PDM-5 Type-BR: made by Konica K.K.). For example, in the case where the chart having five lines per mm was used, when the density of white line was lowered to a level of solid white density as shown in FIG. 6(A), the photosensitive member could pass the resolution test with respect to the chart having five lines per mm. When the density of white line was not lowered to a level of solid white density as shown in FIG. 6(B), the photosensitive member could not pass the resolution test with respect to the chart having five lines per mm.

o: The lowering of resolution power was not observed even after 50000 times of copy and close letters were clearly reproduced. Therefore it could be confirmed that resolution power after 50000 times of copy was as equal as the initial resolution power when a ratio of infrared absorptivity coefficient was optimized according to the present invention.

x: The lowering of resolution power was observed after 50000 times of copy. It was difficult to read close letters. The photosensitive member could not be put into practical use. It could be also confirmed that resolution power was lowered when a ratio of infrared absorptivity coefficient was not within the range of the present invention.

What is claimed is:

1. An electrophotographic photosensitive member comprised of a photosensitive layer and a surface protective layer on an electrically conductive substrate in this order, in which the surface protective layer comprises an amorphous carbon layer and the following ratios of absorptivity coefficients in infrared absorption spectrum of the amorphous carbon layer:

($\alpha_B/\alpha_l$) of absorptivity coefficient ($\alpha_B$) of absorption peak (B) in the range of 2960±10 $cm^{-1}$ to absorptivity coefficient ($\alpha_1$) of absorption peak (1) in the range of 970±10 $cm^{-1}$ is 5.2 or more;

($\alpha_C/\alpha_1$) of absorptivity coefficient ($\alpha_C$) of absorption peak (C) in the range of 2930±10 $cm^{-1}$ to absorptivity coefficient ($\alpha_1$) of absorption peak (1) in the range of 970±10 $cm^{-1}$ is 5.8 or more;

($\alpha_D/\alpha_l$) of absorptivity coefficient ($\alpha_D$) of absorption peak (D) in the range of 2870±10 $cm^{-1}$ to absorptivity coefficient ($\alpha_1$) of absorption peak (1) in the range of 970±10 $cm^{-1}$ is 3.7 or more;

($\alpha_E/\alpha_l$) of absorptivity coefficient ($\alpha_E$) of absorption peak (E) in the range of 1600±40 $cm^{-1}$ to absorptivity coefficient ($\alpha_1$) of absorption peak (1) in the range of 970±10 $cm^{-1}$ is 0.8 or more;

($\alpha_F/\alpha_l$) of absorptivity coefficient ($\alpha_F$) of absorption peak (F) in the range of 1460±20 $cm^{-1}$ to absorptivity coefficient ($\alpha_1$) of absorption peak (1) in the range of 970±10 $cm^{-1}$ is 3.3 or more;

($\alpha_H/\alpha_l$) of absorptivity coefficient ($\alpha_H$) of absorption peak (H) in the range of 1240±10 $cm^{-1}$ to absorptivity coefficient ($\alpha_1$) of absorption peak (1) in the range of 970±10 $cm^{-1}$ is 1.6 or more;

($\alpha_E/\alpha_A$) of absorptivity coefficient ($\alpha_E$) of absorption peak (E) in the range of 1600±40 $cm^{-1}$ to absorptivity coefficient ($\alpha_A$) of absorption peak (A) in the range of 3310±10 $cm^{-1}$ is 1.0 or more;

($\alpha_G/\alpha_A$) of absorptivity coefficient ($\alpha_G$) of absorption peak (G) in the range of 1380±10 $cm^{-1}$ to absorptivity coefficient ($\alpha_A$) of absorption peak (A) in the range of 3310±10 $cm^{-1}$ is 3.8 or more; and ($\alpha_E/\alpha_l$) of absorptivity coefficient ($\alpha_E$) of absorption peak (E) in the range of 1600±40 $cm^{-1}$ to absorptivity coefficient ($\alpha_J$) of absorption peak (J) in the range of 890±10 $cm^{-1}$ is 1.1 or more.

2. An electrophotographic photosensitive member of claim 1, in which the ratio of $\alpha_B/\alpha_l$ is 6.6 or more.

3. An electrophotographic photosensitive member of claim 1, in which the ratio of $\alpha_C/\alpha_l$ is 7.3 or more.

4. An electrophotographic photosensitive member of claim 1, in which the ratio of $\alpha_D/\alpha_l$ is 4.3 or more.

5. An electrophotographic photosensitive member of claim 1, in which the ratio of $\alpha_E/\alpha_l$ is 2.2 or more.

6. An electrophotographic photosensitive member of claim 1, in which the ratio of $\alpha_F/\alpha_l$ is 6.0 or more.

7. An electrophotographic photosensitive member of claim 1, in which the ratio of $\alpha_H/\alpha_l$ is 5.1 or more.

8. An electrophotographic photosensitive member comprised of a photosensitive layer and a surface protective layer on an electrically conductive substrate in this order, in which the surface protective layer comprises an amorphous carbon layer consisting essentially of carbon atoms and hydrogen atoms and the following ratios of absorptivity coefficients in infrared absorption spectrum of the amorphous carbon layer:

($\alpha_B/\alpha_l$) of absorptivity coefficient ($\alpha_B$) of absorption peak (B) in the range of 2960±10 $cm^{-1}$ to absorptivity coefficient ($\alpha_1$) of absorption peak (1) in the range of 970±10 $cm^{-1}$ is 5.2 or more;

($\alpha_C/\alpha_l$) of absorptivity coefficient ($\alpha_C$) of absorption peak (C) in the range of 2930±10 $cm^{-1}$ to absorptivity coefficient ($\alpha_1$) of absorption peak (1) in the range of 970±10 $cm^{-1}$ is 5.8 or more;

($\alpha_D/\alpha_l$) of absorptivity coefficient ($\alpha_D$) of absorption peak (D) in the range of 2870±10 $cm^{-1}$ to absorptivity coefficient ($\alpha_1$) of absorption peak (1) in the range of 970±10 $cm^{-1}$ is 3.7 or more;

($\alpha_E/\alpha_l$) of absorptivity coefficient ($\alpha_E$) of absorption peak (E) in the range of 1600±40 $cm^{-1}$ to absorptivity coefficient ($\alpha_1$) of absorption peak (1) in the range of 970±10 $cm^{-1}$ is 0.8 or more;

($\alpha_F/\alpha_l$) of absorptivity coefficient ($\alpha_F$) of absorption peak (F) in the range of 1460±20 $cm^{-1}$ to absorptivity coefficient ($\alpha_1$) of absorption peak (1) in the range of 970±10 $cm^{-1}$ is 3.3 or more;

($\alpha_H/\alpha_l$) of absorptivity coefficient ($\alpha_H$) of absorption peak (H) in the range of 1240±10 $cm^{-1}$ to absorptivity coefficient ($\alpha_1$) of absorption peak (1) in the range of 970±10 $cm^{-1}$ is 1.6 or more;

($\alpha_E/\alpha_A$) of absorptivity coefficient ($\alpha_G$) of absorption peak (E) in the range of 1600±40 $cm^{-1}$ to absorptivity coefficient ($\alpha_A$) of absorption peak (A) in the range of 3310±10 $cm^{-1}$ is 1.0 or more;

($\alpha_G/\alpha_A$) of absorptivity coefficient ($\alpha_G$) of absorption peak (G) in the range of 1380±10 $cm^{-1}$ to absorptivity coefficient ($\alpha_A$) of absorption peak (A) in the range of 3310±10 $cm^{-1}$ is 3.8 or more; and ($\alpha_E/\alpha_J$) of absorptivity coefficient ($\alpha_E$) of absorption peak (E) in the range of 1600±40 $cm^{-1}$ to absorptivity coefficient ($\alpha_J$) of absorption peak (J) in the range of 890±10 $cm^{-1}$ is 1.1 or more.

9. An electrophotographic photosensitive member comprised of a photosensitive layer and a surface protective layer on an electrically conductive substrate in this order, in which the surface protective layer comprises an amorphous carbon layer and the following ratios of absorptivity coefficients in infrared absorption spectrum of the amorphous carbon layer:

($\alpha_B/\alpha_l$) of absorptivity coefficient ($\alpha_B$) of absorption peak (B) in the range of 2960+10 $cm^{-1}$ to absorptivity coefficient ($\alpha_1$) of absorption peak (1) in the range of 970±10 $cm^{-1}$ is 5.2 or more;

($\alpha_C/\alpha_l$) of absorptivity coefficient ($\alpha_C$) of absorption peak (C) in the range of 2930±10 $cm^{-1}$ to absorptivity coefficient ($\alpha_1$) of absorption peak (1) in the range of 970±10 $cm^{-1}$ is 5.8 or more;

($\alpha_D/\alpha_l$ ) of absorptivity coefficient ($\alpha_D$) of absorption peak (D) in the range of 2870±10 $cm^{-1}$ to absorptivity coefficient ($\alpha_1$) of absorption peak (1) in the range of 970±10 $cm^{-1}$ is 3.7 or more;

($\alpha_E/\alpha_l$) of absorptivity coefficient ($\alpha_E$) of absorption peak (E) in the range of 1600±40 $cm^{-1}$ to absorptivity coefficient ($\alpha_1$) of absorption peak (1) in the range of 970±10 $cm^{-1}$ is 0.8 or more;

($\alpha_F/\alpha_l$) of absorptivity coefficient ($\alpha_F$) of absorption peak (F) in the range of 1460±20 $cm^{-1}$ to absorptivity coefficient ($\alpha_1$) of absorption peak (1) in the range of 970±10 $cm^{-1}$ is 3.3 or more;

($\alpha_H/\alpha_l$) of absorptivity coefficient ($\alpha_H$) of absorption peak (H) in the range of 1240±10 $cm^{-1}$ to absorptivity coefficient ($\alpha_A$) of absorption peak (1) in the range of 970±10 $cm^{-1}$ is 1.6 or more;

($\alpha_E/\alpha_A$) of absorptivity coefficient ($\alpha_E$) of absorption peak (E) in the range of 1600±40 $cm^{-1}$ to absorptivity coefficient ($\alpha_A$) of absorption peak (A) in the range of 3310±10 $cm^{-1}$ is 1.0 or more;

($\alpha_G/\alpha_A$) of absorptivity coefficient ($\alpha_G$) of absorption peak (G) in the range of 1380±10 $cm^{-1}$ to absorptivity coefficient ($\alpha_A$) of absorption peak (A) in the range of 3310±10 $cm^{-1}$ is 3.8 or more;

($\alpha_E/\alpha_J$) of absorptivity coefficient ($\alpha_E$) of absorption peak (E) in the range of 1600±40 $cm^{-1}$ to absorptivity coefficient ($\alpha_J$) of absorption peak (J) in the range of 890±10 $cm^{-1}$ is 1.1 or more; the electrophotographic photosensitive member having a resolution power of 6.5 lines/mm or more after image forming processes after 50,000 times.

10. An electrophotographic photosensitive member of claim 9, in which the ratio of $\alpha_B/\alpha_l$ is 6.6 or more.

11. An electrophotographic photosensitive member of claim 9, in which the ratio of $\alpha_C/\alpha_l$ is 7.3 or more.

12. An electrophotographic photosensitive member of claim 9, in which the ratio of $\alpha_D/\alpha_l$ is 4.3 or more.

13. An electrophotographic photosensitive member of claim 9, in which the ratio of $\alpha_E/\alpha_l$ is 2.2 or more.

14. An electrophotographic photosensitive member of claim 9, in which the ratio of $\alpha_F/\alpha_l$ is 6.0 or more.

15. An electrophotographic photosensitive member of claim 9, in which the ratio of $\alpha_H/\alpha_l$ is 5.1 or more.

16. An electrophotographic photosensitive member of claim 1 wherein the electrophotographic photosensitive member has a resolution power of 6.5 lines/mm or more after image forming processes after 50,000 times.

17. An electrophotographic photosensitive member of claim 8 wherein the electrophotographic photosensitive member has a resolution power of 6.5 lines/mm or more after image forming processes after 50,000 times.

18. An electrophotographic photosensitive member comprised of a photosensitive layer and a surface protective layer on an electrically conductive substrate in this order, in which the surface protective layer comprises an amorphous carbon layer and at least one ratio of absorptivity coefficients in infrared absorption spectrum of the amorphous carbon layer which is selected from the group consisting of:

($\alpha_B/\alpha_l$) of absorptivity coefficient ($\alpha_B$) of absorption peak (B) in the range of 2960±10 $cm^{-1}$ to absorptivity coefficient ($\alpha_1$) of absorption peak (1) in the range of 970±10 $cm^{-1}$ is 5.2 or more;

($\alpha_C/\alpha_l$) of absorptivity coefficient ($\alpha_C$) of absorption peak (C) in the range of 2930±10 $cm^{-1}$ to absorptivity coefficient ($\alpha_1$) of absorption peak (1) in the range of 970±10 $cm^{-1}$ is 5.8 or more;

($\alpha_D/\alpha_l$) of absorptivity coefficient ($\alpha_D$) of absorption peak (D) in the range of 2870±10 $cm^{-1}$ to absorptivity coefficient ($\alpha_1$) of absorption peak (1) in the range of 970±10 $cm^{-1}$ is 3.7 or more;

($\alpha_E/\alpha_l$) of absorptivity coefficient ($\alpha_E$) of absorption peak (E) in the range of 1600±40 $cm^{-1}$ to absorptivity coefficient ($\alpha_1$) of absorption peak (1) in the range of 970±10 $cm^{-1}$ is 0.8 or more;

($\alpha_F/\alpha_l$) of absorptivity coefficient ($\alpha_F$) of absorption peak (F) in the range of 1460±20 $cm^{-1}$ to absorptivity coefficient ($\alpha_1$) of absorption peak (1) in the range of 970±10 $cm^{-1}$ is 3.3 or more; and ($\alpha_H/\alpha_l$) of absorptivity coefficient ($\alpha_H$) of absorption peak (H) in the range of 1240±10 $cm^{-1}$ to absorptivity coefficient ($\alpha_1$) of absorption peak (1) in the range of 970±10 $cm^{-1}$ is 1.6 or more;

the electrophotographic photosensitive member having a resolution power of 6.5 lines/mm or more after image forming processes after 50,000 times.

19. An electrophotographic photosensitive member of claim 1, in which the ratio of $\alpha_E/\alpha_A$ is 3.9 or more.

20. An electrophotographic photosensitive member of claim 1, in which the ratio of $\alpha_G/\alpha_A$ is 4.8 or more.

21. An electrophotographic photosensitive member of claim 1, in which the ratio of $\alpha_E/\alpha_J$ is 1.8 or more.

22. An electrophotographic photosensitive member of claim 8, in which the ratio of $\alpha_E/\alpha_A$ is 3.9 or more.

23. An electrophotographic photosensitive member of claim 8, in which the ratio of $\alpha_G/\alpha_A$ is 4.8 or more.

24. An electrophotographic photosensitive member of claim 8, in which the ratio of $\alpha_E/\alpha_J$ is 1.8 or more.

25. An electrophotographic photosensitive member of claim 9, in which the ratio of $\alpha_E/\alpha_A$ is 3.9 or more.

26. An electrophotographic photosensitive member of claim 9, in which the ratio of $\alpha_G/\alpha_A$ is 4.8 or more.

27. An electrophotographic photosensitive member of claim 9, in which the ratio of $\alpha_E/\alpha_J$ is 1.8 or more.

* * * * *